United States Patent [19]

Vanetik et al.

[11] Patent Number: 4,691,605

[45] Date of Patent: Sep. 8, 1987

[54] CUTTER ASSEMBLY WITH ROTATING KNIFE BLADE

[75] Inventors: Anatoly Vanetik, Fullerton; Brian C. Preston, Anaheim, both of Calif.

[73] Assignee: Sanders Associates, Inc., Nashua, N.H.

[21] Appl. No.: 757,618

[22] Filed: Jul. 22, 1985

[51] Int. Cl.[4] ..... B26D 7/14

[52] U.S. Cl. ..... 83/175; 83/485; 83/488; 83/508

[58] Field of Search ..... 83/485, 488, 489, 508, 83/614, 175, 374, 451

[56] References Cited

U.S. PATENT DOCUMENTS

| | | | |
|---|---|---|---|
| 1,156,224 | 10/1915 | Harwood | 83/485 X |
| 3,693,489 | 9/1972 | Pearl | 83/374 |
| 3,766,816 | 10/1973 | Loveless | 83/489 |
| 3,859,882 | 1/1975 | Demuth | 83/485 X |
| 4,152,962 | 5/1979 | Hendrischk | 83/485 X |
| 4,448,101 | 5/1984 | Templeton | 83/374 |

*Primary Examiner*—James M. Meister

*Attorney, Agent, or Firm*—Richard I. Seligman; William F. Porter, Jr.

[57] ABSTRACT

A cutter assembly (82) for cutting web material such as paper (80) includes a circular cutter (100) having an endless peripheral blade (102) mounted on a frame (92) on which also is mounted a tension roller in the form of a pulley (94). A smaller pulley (98) is mounted on and co-axial with the circular cutter 100, and a belt (96) is trained around the pulleys (94 and 98). The portion of the belt (96) on the tension roller (94) provides an engagement surface adapted to engage the paper (80) so that movement of the cutter assembly (82) causes rotation of the tension roller (94) and thus faster rotation of the circular cutter (100). This results in efficient cutting of the paper (80) and high cut quality because the tension roller (94) prevents bunching of the paper (80) in the vicinity of the endless blade (102).

3 Claims, 15 Drawing Figures

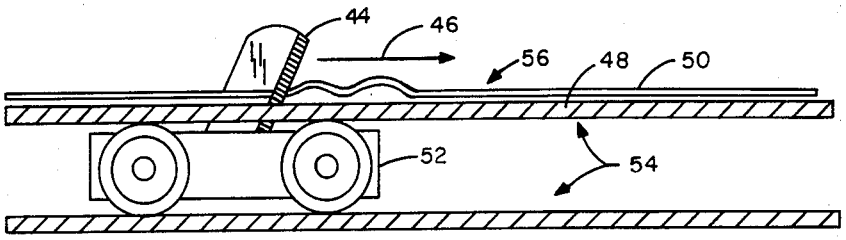
PRIOR ART
FIG. 5
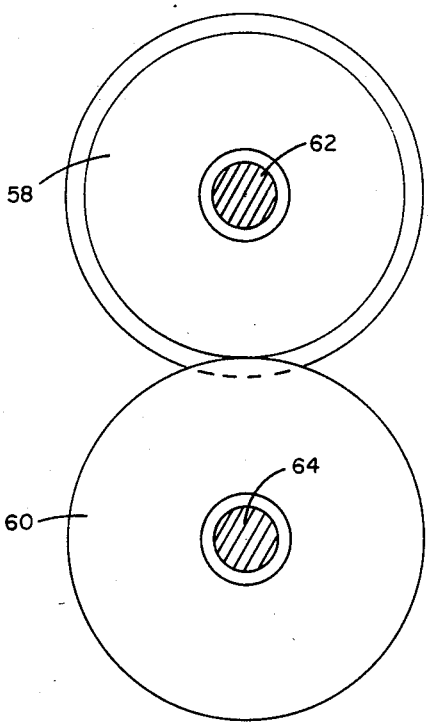
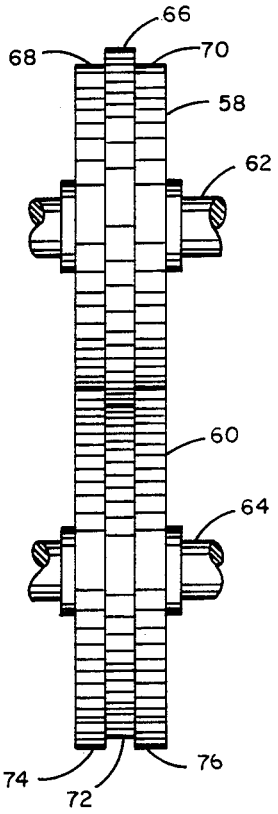
FIG. 6 PRIOR ART FIG. 7 PRIOR ART

CUTTER ASSEMBLY WITH ROTATING KNIFE BLADE

BACKGROUND OF THE INVENTION

The present invention is directed to devices for cutting web material such as paper. It is intended particularly, but not exclusively, for transversely cutting sheets from continuous rolls of paper.

In some printers and plotters, paper is fed to the print mechanism from a continuous roll. Such a printer may be of the type illustrated generally in FIG. 1, in which a paper web 10 is fed from a supply roll 12 to a print station 14, where it is imprinted in accordance with signals from a control circuit 16. A take-up roll 18 draws the imprinted paper 20 from the print station 14 in response to signals from the control circuitry 16. At appropriate times, the continuous paper is cut at a cutting station 22, typically when a completed document has been printed. The FIG. 1 illustration suggests a cutting station of the guillotine type, in which a knife edge is driven perpendicularly to the paper to cut the entire sheet at one time. This requires a certain coordination between the take-up roll 18 and the cutting station 22 in order to insure that the paper 20 has stopped when the cutting operation is performed.

An example of a different type of a cutting mechanism is depicted in FIGS. 2–4, in which a stationary central cylinder 24 provides front and rear axially extending openings 26 and 28 through which paper can extend, guided by a paper guide 30 interior to the central cylinder 24. Mounted coaxial with the stationary cylinder 24 and exterior to it is a rotatable cylinder 32, which has front and rear openings 34 and 36. The outer cylinder 32 is biased to the position illustrated in FIG. 2, in which its front and rear openings 34 and 36 are disposed in registration with the front and rear openings 26 and 28 of the inner cylinder so that paper can extend through openings in both cylinders. To cut the paper, the outer cylinder 32 is rotated clockwise in FIG. 2 so that the upper edge 38 (FIG. 4) of the outer-cylinder opening 34 moves across the lower edge 40 of the inner-cylinder front opening 26 to sever the paper 42. Preferably, the outer-cylinder upper edge 38 forms a slight axial angle with the inner-cylinder lower edge 40 so that the cutting point moves across the openings—i.e., the paper is not cut along its entire width simultaneously. This clearly provides an advantage over the guillotine-type mechanism. However, it is slightly elaborate mechanically, and this is not entirely desirable in lower-cost printers and plotters, in which reliability and simplicity are important attributes.

For such printers, a simple cutting mechanism such as that illustrated in FIG. 5 has been proposed. In this cutting mechanism, a blade 44 is drawn transversely in the direction of arrow 46 across the bed 48 that supports the paper sheet 50. The blade can be mounted on a carrier 52 that rides in a track 54 across the path of the paper. While such an arrangement clearly has the virtue of simplicity, it has a drawback not found in the guillotine-type cutter, namely, that the paper tends to bunch up ahead of the blade 44, as is suggested in FIG. 5 by paper region 56. Furthermore, it shares a further disadvantage with all of these arrangements, which is that the blade edge tends to become dull quite rapidly, thereby increasing maintenance—i.e., sharpening—costs or degrading cut quality if the sharpening is not performed frequently enough.

A further prior-art arrangement for paper cutting is depicted in FIGS. 6 and 7, in which two discs 58 and 60 rotate about parallel shafts 62 and 64. The upper disc 58 has a large-diameter central portion 66 between two smaller-diameter portions 68 and 70. The lower disc 60 has a smaller-diameter portion 72 between two larger-diameter portions 74 and 76 so that the peripheries of the two discs 58 and 60 are complementary. The discs 58 and 60 thus cut paper at the point at which the periphery of the center portion 66 of the upper disc 58 intersects the peripheries of the outer portions 74 and 76 of the lower disc 60. While the arrangement of FIGS. 6 and 7 also has a certain degree of simplicity, it also suffers from the tendency to cause paper to bunch and thus result in ragged cuts.

Accordingly, an object of the present invention is to obtain high and reliable cutting quality in a cutting mechanism that is relatively simple and thus reliable.

Summary of the Invention

The foregoing and related objects are achieved in a cutter assembly in which a drag roller and a circular cutter are mounted on a frame that can be moved across the surface of web material to be cut. The drag roller provides an engagement surface around its periphery that frictionally engages the paper so that the roller is caused to rotate by relative motion between the frame and the web. The circular cutter is mounted on the frame for rotation about its axis, which is parallel to that of the drag roller. To cut the paper, the cutter assembly is moved across the paper in a direction perpendicular to the axes of the drag roller and circular cutter, and a cutting edge on the periphery of the circular cutter comes in contact with the web to cut it. The drag roller precedes the cutter across the paper, and means are provided for rotating the circular cutter so that the peripheral speed of its cutting edge differs from the translational speed of the cutter assembly and the drag roller in such a manner as to apply tension to that part of the paper that lies between the drag roller and the cutter. Means for causing this motion may, for instance, be a belt connecting pulleys on the drag roller and the circular cutter, the pulley diameters being so related that the peripheral speed of the cutting edge differs from that of the drag roller engagement surface. We have found that such a mechanism is simple and results in high cutting quality and a relatively long time between blade sharpenings.

BRIEF DESCRIPTION OF THE DRAWING

These and further features and advantages of the present invention are described in connection with the accompanying drawings, in which:

FIGS. 1–7 depict the prior-art arrangements previously discussed;

DETAILED DESCRIPTION OF THE PREFERRED EMBODIMENTS

Figure 1:
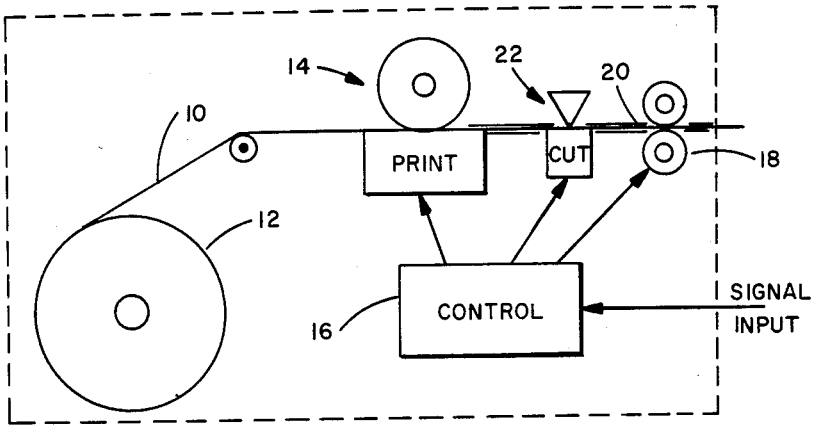
FIG. 1 PRIOR ART
Figure 2:
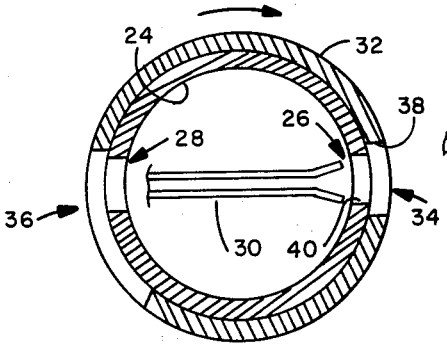
FIG. 2 PRIOR ART
Figure 4:
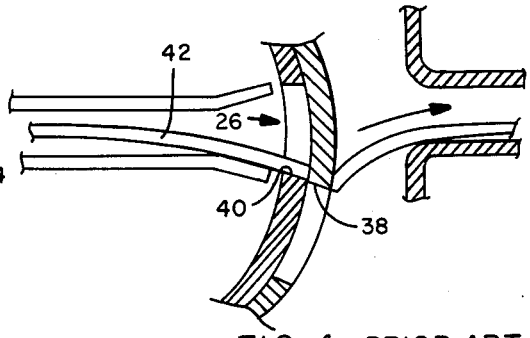
FIG 4. PRIOR ART
Figure 3:
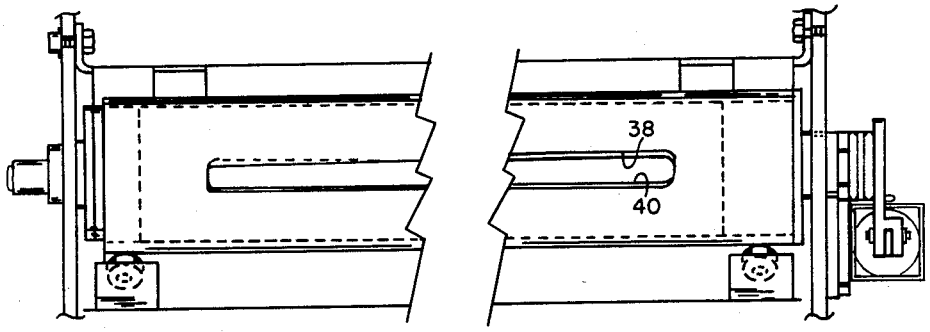
FIG. 3 PRIOR ART
Figure 8:
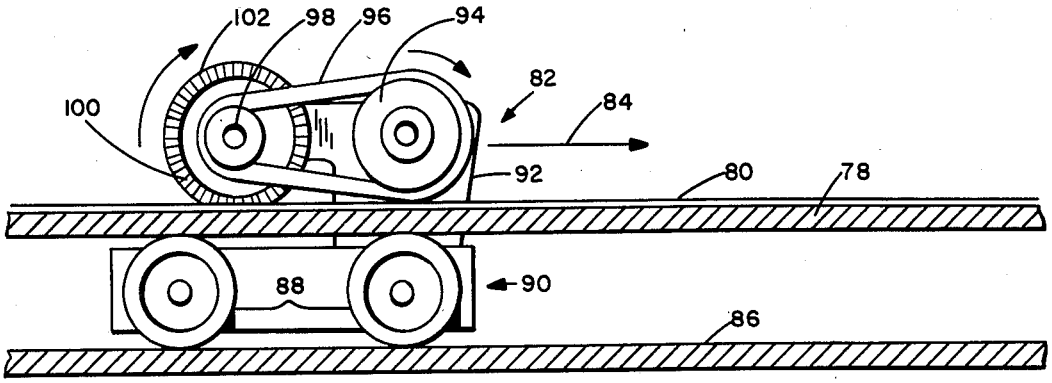
FIG. 8 is a simplified side elevation of one embodiment of the present invention.

FIG. 8 depicts one embodiment of the present invention, in which a support surface 78 supports a paper web 80. In FIG. 8, the direction of paper feed is into or out of the page, and the cutter assembly 82 of the present invention travels across the page in the direction indicated by arrow 84 to cut the paper transversely of its longitudinal dimension. A lower rail 86 cooperates with the upper support 78 to form a track that guides wheels 88 of a carriage portion 90 of the cutter assembly. A bracket 92 extends up through a transverse slot in the support 78 and has mounted on it a drag roller 94 in the form of a pulley. A belt 96 is trained around this pulley and a second pulley 98, which is provided on a circular cutter 100 whose periphery is an endless blade 102. The drag roller 94 and cutter 100 are mounted for rotation about parallel axes, which are spaced apart in the direction of motion of the cutter assembly 82.

In operation the belt 96 acts as an engagement surface of the drag roller 94; it engages the paper web 80 so that when the cutter assembly 82 is pushed across the paper path in the direction indicated by arrow 84, friction between the paper 80 and the belt 96 causes rotation of the drag roller 94. This causes the belt 96 to drive the cutter pulley 98 and thus the endless blade 100, which extends down through the plane of the paper into the slot provided for the cutter bracket 92. Because the diameter of pulley 94 is greater than that of pulley 98, the cutter 100 rotates at an angular speed higher than that of the drag roller 94. Since the angular speed of the cutter 100 is greater than that of the drag roller 94, and since the diameter of the blade 102 is greater than that of the engagement surface that the belt 96 provides on the drag roller 94, the blade 102 moves peripherally with respect to the paper 80, and we believe that this motion contributes to cutting effectiveness. Furthermore, the drag of the cutter, which the exterior surface of the belt imparts to the paper 80, causes a tension on it that prevents the paper 80 from crumpling in the vicinity of the blade 102. This enhances the quality of the resultant cut.

Figure 9:
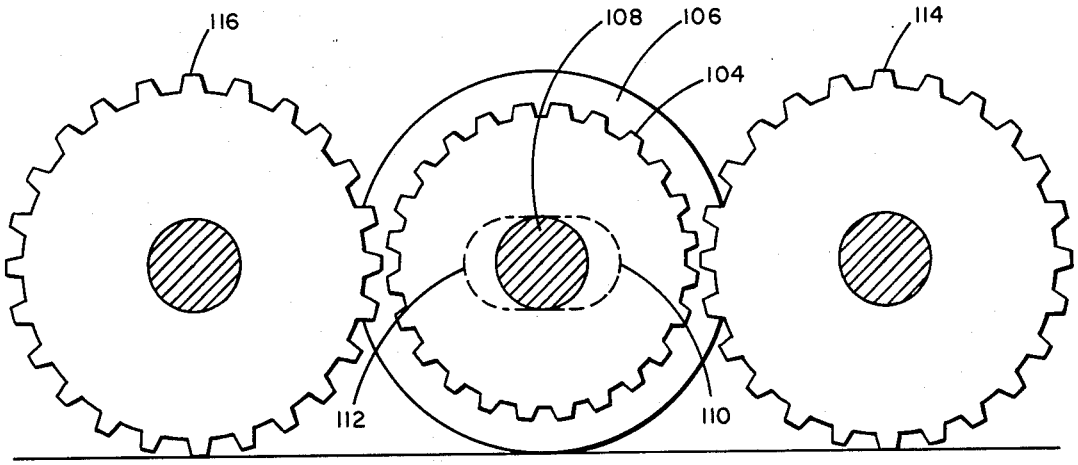
FIGS. 9–11 are diagrammatic views of the engagement of the circular cutter and the drag rollers in a two-direction version of the present invention.
Figure 10:
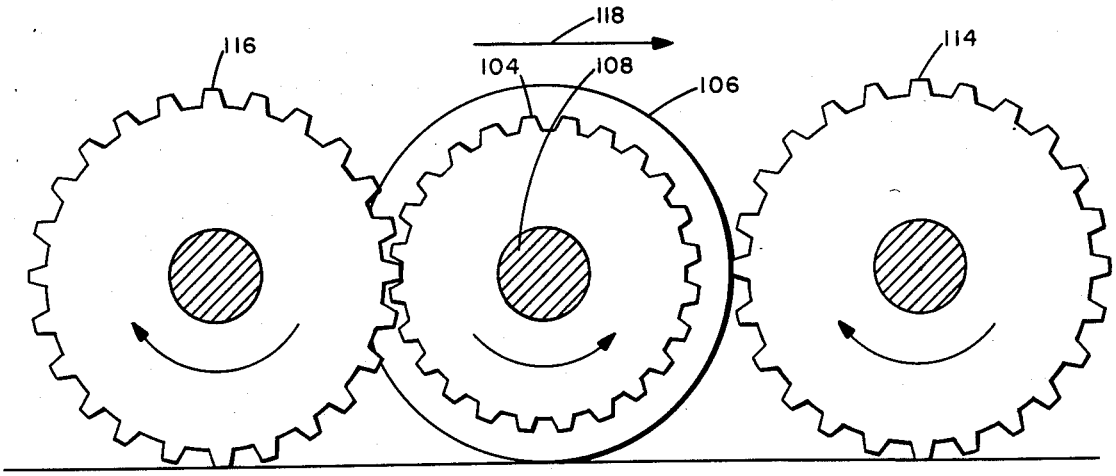
Figure 11:
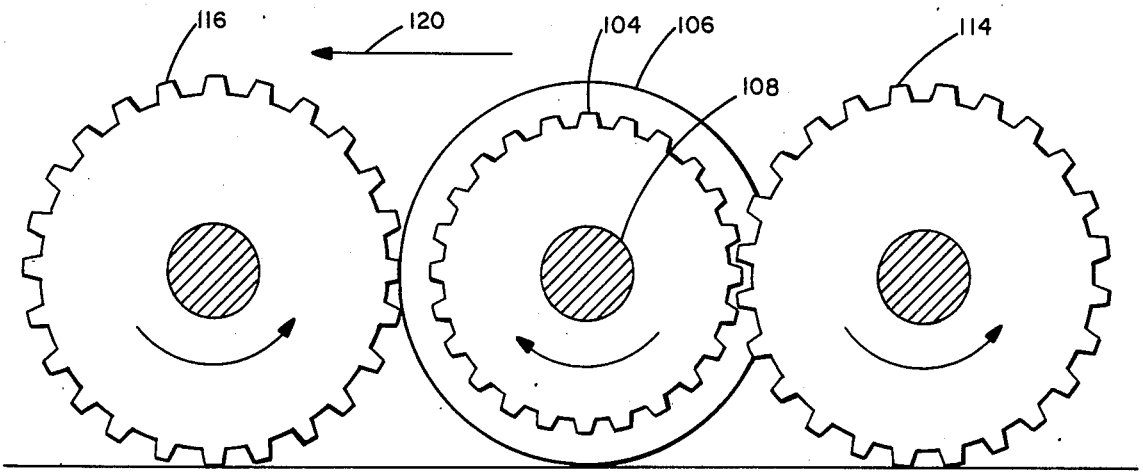

The same principle is employed in a two-directional cutter assembly shown diagrammatically in FIGS. 9–11. In FIG. 9, a gear 104 is attached to the cutter 106, which is mounted on a bracket, not shown, similar to bracket 96, for rotation about the axis of a shaft 108. The shaft 108 is shown in a neutral position on the frame, but it can be moved between two positions represented by dashed circles 110 and 112. In those positions, it engages one of two further gears 114 and 116, which are provided on separate drag rollers (not shown). To cut in the right-hand direction, as FIG. 10 illustrates, the shaft 108 is moved to its left position on the frame, in which gear 104 meshes with gear 116 but not with gear 114. The drag roller on which gear 114 is provided precedes the cutter 106 and engages the paper so as to prevent crumpling in the cutter region. The roller on which gear 116 is provided also engages the paper, rotating as the assembly moves in the direction indicated by arrow 118, and thereby causes the cutter 106 to rotate counterclockwise. Since gear 116 is larger than gear 104, the rotational speed of the cutter 106 is again greater than that of the drag rollers, but, in this case, the direction of the peripheral motion of the cutter at the point at which it meets the paper is the same as the direction of motion of the cutter assembly. While one might suppose that this would tend to compromise the beneficial effect that the drag rollers provide, we have that the presence of the tension rollers and their relatively close proximity to the endless blade still prevent crumpling.

As FIG. 11 shows, shaft 108 is moved to the right to enable the cutter to cut in the direction indicated by arrow 120 of FIG. 11. In this position, gear 104 meshes with gear 114, and the operation described in connection with FIG. 10 is reversed.

Figure 12:
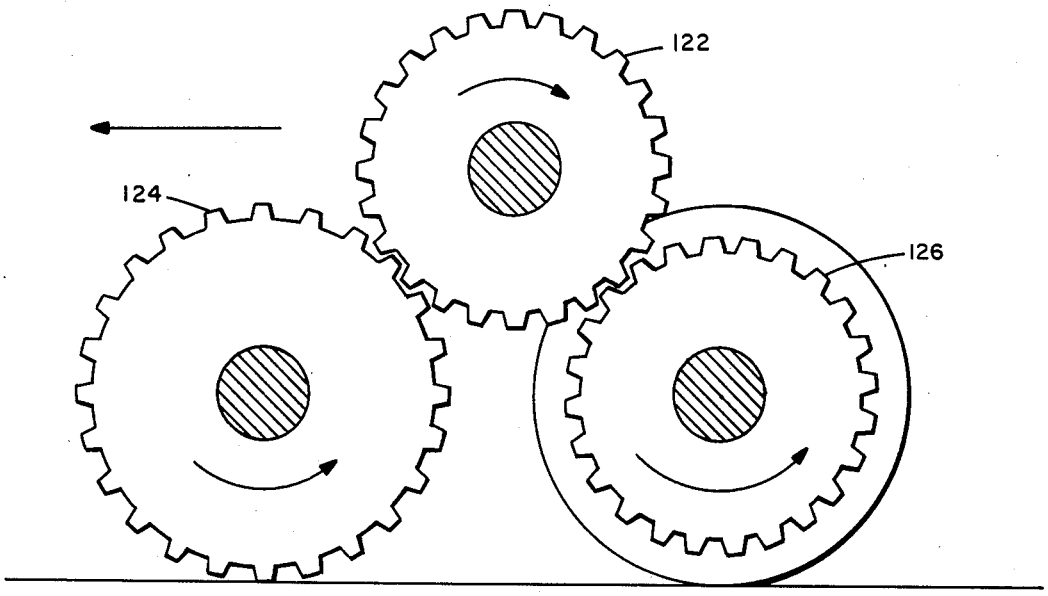
FIG. 12 is a similar view of another two-directional version of the present invention.

As was stated above, the arrangement of FIGS. 9–11, which employs gears instead of belt pulleys, results in peripheral motion of the blade 106 in the region of the paper in the same direction as that of the translational motion of the cutter assembly. This result is not necessary, of course, as FIG. 12 indicates. In FIG. 12, a reversing gear 122 meshes with a tension-roller gear 124 and a cutter gear 126 to cause the peripheral motion of the cutter in the vicinity of the paper to be in a direction opposite to that of the translational motion of the cutter assembly.

Figure 13:
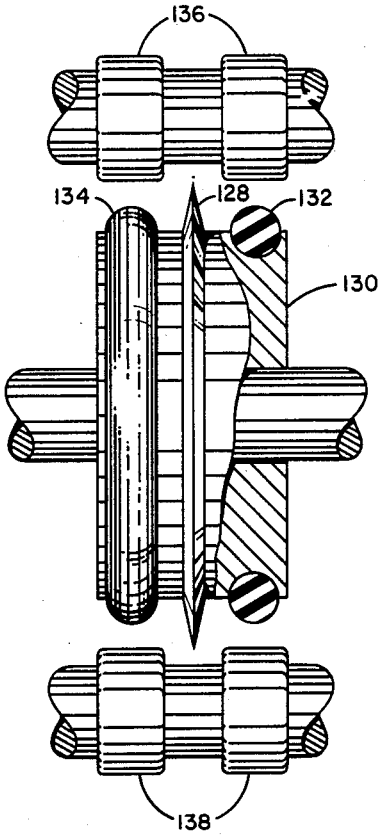
FIG. 13 is a simplified plan view of a further variation of the present invention.
Figure 14:
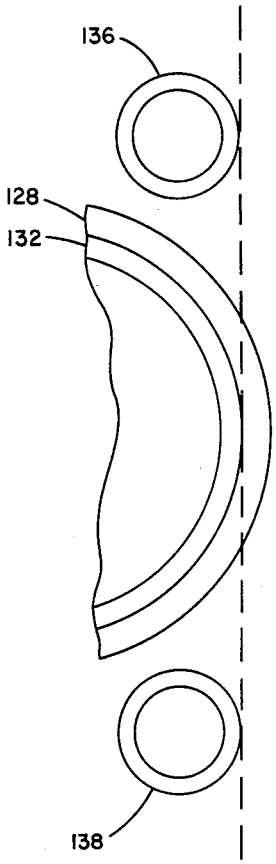
FIG. 14 is a simplified side elevation of a part of the embodiment depicted in FIG. 13.

In all of the arrangements described so far, the tangential motion of the cutter with respect to the paper has been achieved by using a mechanical advantage to drive the cutter at an angular speed different from that of a roller driven by the relative motion between the paper and the cutter assembly. Such an arrangement is not necessary in order to achieve certain of the benefits of the present invention. This fact is illustrated by FIGS. 13 and 14, which depict another two-directional version of the present invention. In FIGS. 13 and 14, the endless blade 128 is incorporated in a roller 130 having high-friction O-rings 132 and 134 extending around its periphery to provide an engagement surface. Tension rollers 136 are disposed on one side of the blade 128 to precede it when the cutter moves in one direction, and further tension rollers 138 are disposed on the other side of the blade 128 to precede it when it cuts in the other direction.

In the arrangement illustrated in FIGS. 13 and 14, the blade 128 is driven by the engagement of the O-rings 132 and 134 with the paper, so there is no need for a driving connection between it and the drag rollers 136 and 138. The tangential motion of the blade 128 with respect to the paper results from the fact that, although the blade rotates at the same angular speed as do the O-rings that engage the paper, its diameter is greater.

Figure 15:
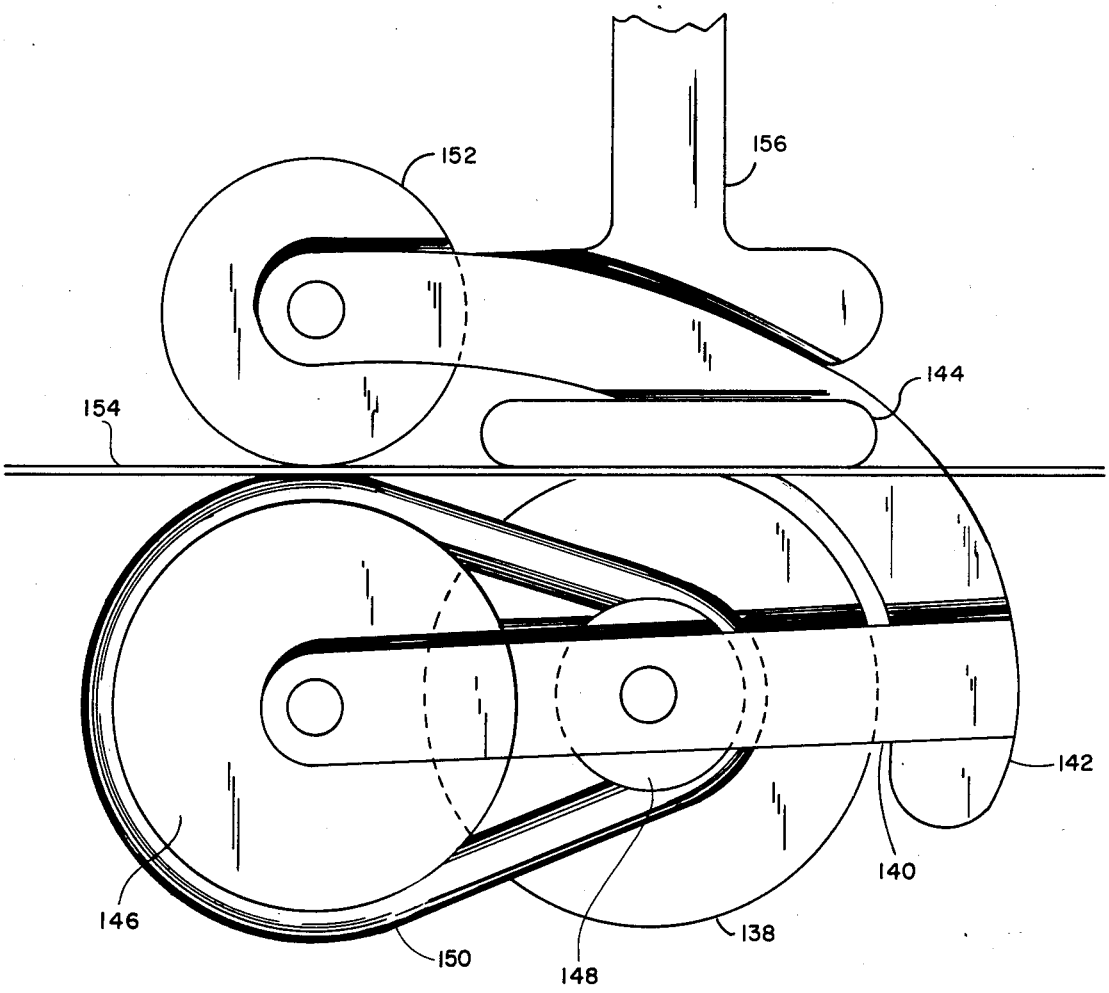
FIG. 15 is a simplified side elevation of yet another version of the present invention.

FIG. 15 depicts a final embodiment of the present invention. The embodiment depicted in FIG. 15 does not require a separate support surface such as surface 48 of FIG. 5. In FIG. 15, the cutter 138 is mounted on a bracket 140 extending from a frame 142 on which a platen 144 is mounted. The platen 144 provides a slot that receives the blade of the cutter 138. Also mounted on the bracket 140 is a drag roller in the form of a pulley 146. A smaller pulley is provided on the cutter 138, and a belt 150 is trained about pulleys 146 and 148. A support roller 152 mounted on the frame 142 is disposed closely adjacent to the belt 150 to hold paper 154 in engagement with it. The cutter assembly is moved to the left in FIG. 15 by a user holding a handle 156 also mounted on the frame 142. Because the paper 154 is held in engagement with the belt 150, the drag roller 146 is caused to rotate and drive the cutter 138 a manner similar to that described in connection with FIG. 8.

We have found that cutters designed in accordance with the principles of the present invention provide a simple means of making high-quality cuts in paper and similar flexible web material without the need for excessive maintenance. Because the endless blade rotates, it wears evenly along its entire edge. The drag roller preceding the endless blade prevents the paper cumpling that can detract from cutting quality in other devices. Accordingly, the present invention constitutes a significant advance in the art.

We claim:

1. For cutting web material, a cutter assembly comprising:

A. frame;

B. a drag roller rotatably mounted on the frame for rotation about a drag-roller axis, the drag roller having a peripheral engagement surface adapted for engagement of web material so that the drag roller is caused to rotate when the frame and drag roller move with respect to the web material in a direction perpendicular to the drag-roller axis while the web material engages the engagement surface;

C. a circular cutter rotatably mounted on the frame for rotation about a cutter axis substantially parallel to the drag-roller axis, the cutter having a periperal endless blade and being disposed with respect to the drag roller for cutting engagement of web material by endless blade while the drag-roller engagement surface engages the web material; and D. means connected to the drag roller for rotating the cutter, when the frame moves with respect to the web material in the direction in which the tension roller precedes the cutter, at such speed that the peripheral speed of the endless blade differs from the speed of the cutter assembly and the drag roller with respect to the web material so that the web material is effectively maintained in tension at the point at which the endless blade engages the web as relative movement occurs between the web and the cutter assembly.

2. A cutter assembly as defined in claim 1 wherein the cutter includes a cutter pulley thereon and the drag roller includes a drag-roller pulley thereon and wherein the means for rotating the cutter includes a belt trained around the drag-roller and cutter pulleys to cause the cutter pulley and thus the cutter to rotate with rotation of the drag roller and thus of the drag-roller pulley.

3. A cutter assembly as defined in claim 2 wherein the diameter of the cutter pulley is less than that of the drag roller pulley so that the cutter rotates at a higher angular speed than the drag roller does.

* * * * *